United States Patent [19]

Adler

[11] 4,062,460

[45] Dec. 13, 1977

[54] GATE OPERATING MECHANISM FOR A HOPPER CAR

[75] Inventor: Franklin P. Adler, Michigan City, Ind.

[73] Assignee: Pullman Incorporated, Chicago, Ill.

[21] Appl. No.: 706,718

[22] Filed: July 19, 1976

[51] Int. Cl.[2] ..... B65G 67/24

[52] U.S. Cl. ..... 214/58; 105/241 C

[58] Field of Search ..... 214/58, 63; 105/241 C, 105/251, 308, 310

[56] References Cited

U.S. PATENT DOCUMENTS

| | | | |
|---|---|---|---|
| 1,300,962 | 4/1919 | Hart | 105/251 |
| 2,364,554 | 12/1944 | Sanford | 214/58 |
| 2,686,479 | 8/1954 | Shields et al. | 214/63 |
| 3,790,008 | 2/1974 | Joubert | 105/241 C |

*Primary Examiner*—Robert J. Spar
*Assistant Examiner*—Lawrence E. Williams
*Attorney, Agent, or Firm*—Thomas G. Anderson

[57] ABSTRACT

A bottom dump railway car includes gravity biased gates which are moved outwardly to an open position. Each gate includes an outwardly projecting arm having a cam follower mounted thereon. Track side cams are engaged by the cam followers which engage cam surfaces extending diagonally upwardly and arcuately outwardly so as the car travels along the cams the doors are moved outwardly to open positions.

6 Claims, 6 Drawing Figures

GATE OPERATING MECHANISM FOR A HOPPER CAR

BACKGROUND OF THE INVENTION

1. Field of the Invention

The present invention relates generally to railway cars having a plurality of hoppers and discharge openings at the lower ends thereof through which material is discharged. More specifically the invention relates to a bottom discharge door arrangement wherein the doors are opened by means of camming devices positioned adjacent the railway track.

2. Description of the Prior Art

The prior art is disclosed in U.S. Pat. Nos. 2,640,610, June 2, 1953; 3,227,100, Jan. 4, 1966; 3,314,558, Apr. 18, 1967; 3,316,858, May 2, 1967; 2,441,978, May 25, 1948; 3,452,886, July 1, 1969; 3,459,316, Aug. 5, 1969 and 3,872,796, Mar. 25, 1975. The present invention is an improvement over the structures shown in the aforementioned patents.

SUMMARY OF THE INVENTION

The present invention relates to a hopper car having bottom discharge openings through which coal or other comminuted materials are discharged through the tracks into receiving bins. The gates or doors of the present invention are normally biased to a closed position by means of gravity assisted by the load within the hopper. The present invention relates to a simplified construction wherein the doors may be opened by means of a track side cam arrangement. The track side cams are arranged on opposite sides of the car and each includes vertical pedestals which support a cam track having a cam engaging surface. The cam engaging surface extends substantially longitudinally with respect to the direction of travel of the car and is curved from a low point arcuately outwardly and upwardly to its highest point. Thus the cam in addition to being curved is sloped or extends diagonally with respect to the ground on which it is supported. Each of the doors is provided with arms extending laterally outwardly having provided at the ends thereof cam followers which are adapted to engage the cam surfaces and as the railway car moves alongside the camming arrangements the cam followers travel upwardly on the cam surfaces forcing the doors outwardly thereby exposing the discharge openings and the load within the hopper car is thus discharged.

A locking lever also, in one embodiment of the invention, is pivotally supported on the arm and in turn supports the cam follower which in the present disclosure is illustrated as being a roller. The lever extends laterally outwardly with the arm and is supported thereon by means of a ledge and a stop member. The stop member is suitably supported on a downwardly extending bracket and is adapted to engage a notch within the lever the assembly thus preventing any outward movement of the gravity biased doors or gate. When the cam follower engages the camming surfaces of the track side cams the notched lever with the follower is moved upwardly until it is restrained by means of an over-lying flange provided on the arm whereupon the door may now be swung laterally outwardly since the levers have been disengaged from the locking engagement with respect to the stop members. Thus the doors are now moved outwardly to their opened position whereupon the load is discharged and after the car travels past the track side cams they are again moved by gravity to their closed positions.

DESCRIPTION OF THE PREFERRED EMBODIMENT

Figure 1:
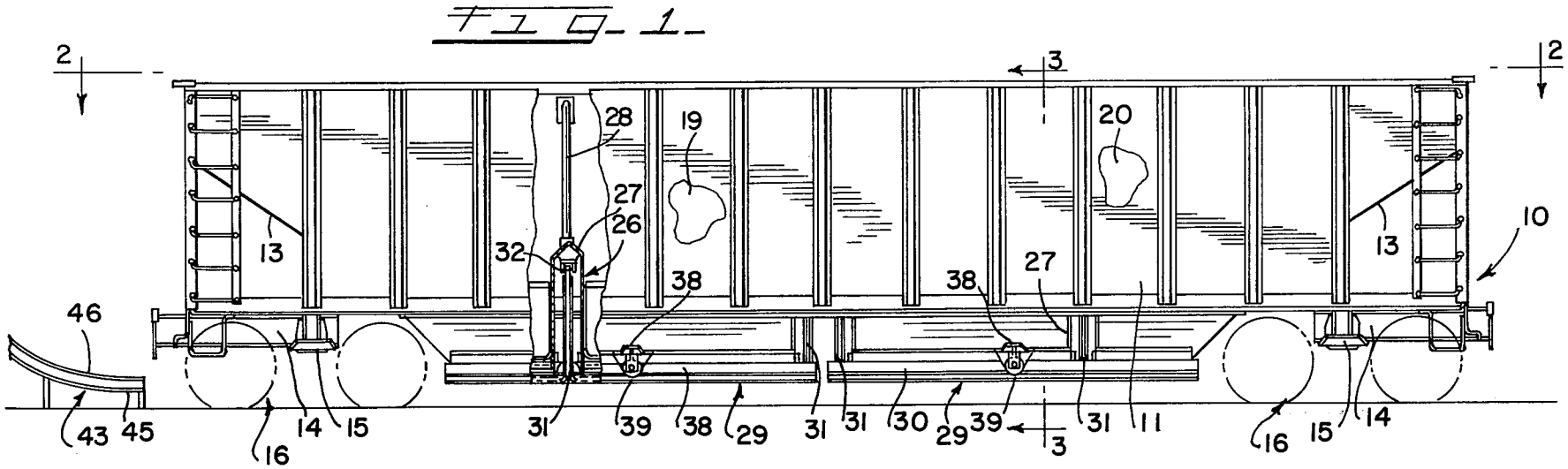
FIG. 1 is a side elevational view of a railway hopper car with portions broken away to show the interior parts thereof.

A railway car 10, which in the present invention is of the open top type, includes side walls 11 and end walls 12. The inner portion of the car 10 is provided with sloping hopper end walls 13 and the car is suitably supported of stub center sills 14 having bolster structures 15 supported in turn on conventional wheel trucks 16.

Figure 4:
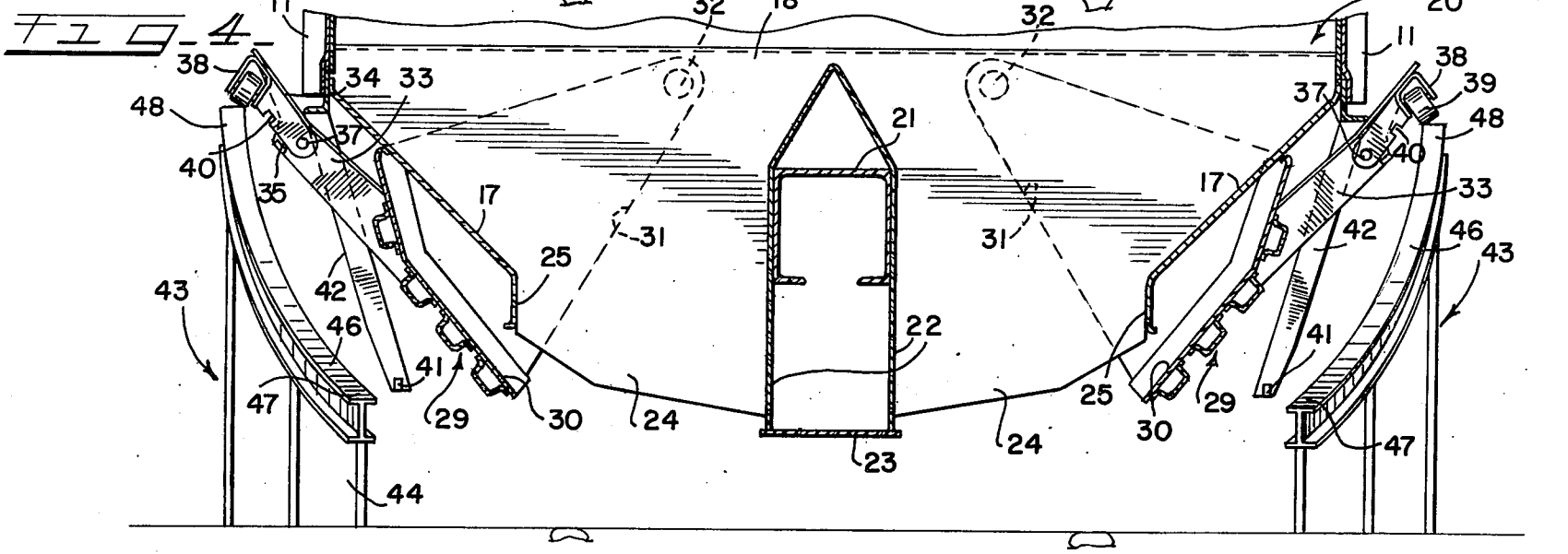
FIG. 4 is a cross-sectional view similar to FIG. 3 showing another operating position of a pair of discharge gates.

The car 10 also includes sloping side hopper walls 17 and a central transversely extending partition wall 18 which separates the car 10 in to a pair of spaced hoppers 19 and 20. Each hopper 19 and 20 includes a central longitudinally extending divider wall structure 21 including vertical plates 22 connected by bottom plates 23. As best shown in FIG. 4, the side walls 22 and flanges 25 on the sloping wall 17 provide therebetween spaced openings 24 through which material may be discharged from the hopper.

Figure 2:
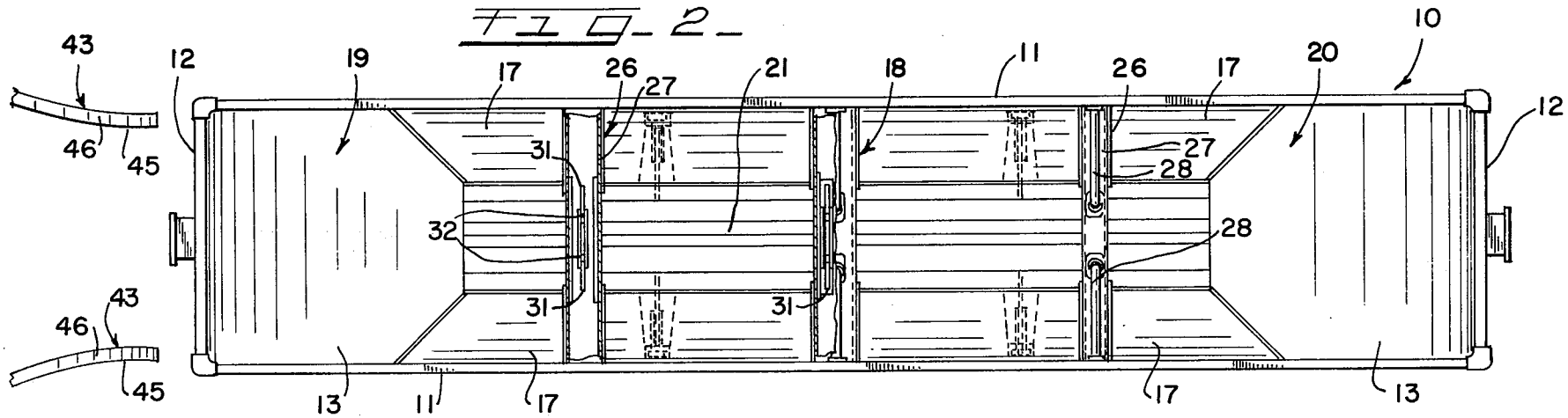
FIG. 2 is a plan view of the car shown in FIG. 1.

Referring now generally to FIGS. 1 and 2 the railway car 10 also includes within the hoppers 19 and 20 transversely extending partitions or well structures 26. Each of these is formed by a transversely extending housing 27 also connected to the side walls 11 by means of diagonal supports 28. The openings 24 thus, extend from the central partition walls 18 longitudinally in opposite directions to the lower ends of the sloping end walls 13. The housings 26 extend partially upwardly within each of the hoppers 19 and 20 to provide supports for the closure door structures generally designated by the reference character 29. Each of the door structures 29 includes a closure door panel 30, these panels extending the length of the openings 24 for suitably closing them.

Figure 3:
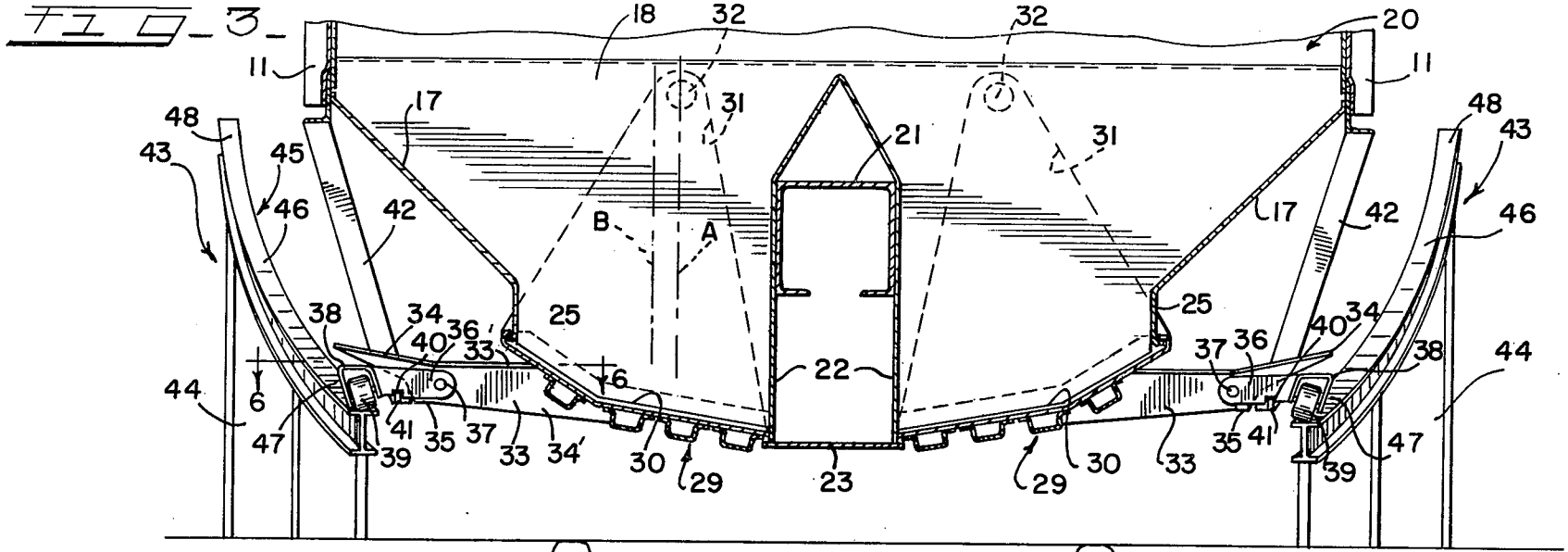
FIG. 3 is a cross-sectional view taken substantially along the line 3—3 of FIG. 1.
Figure 5:
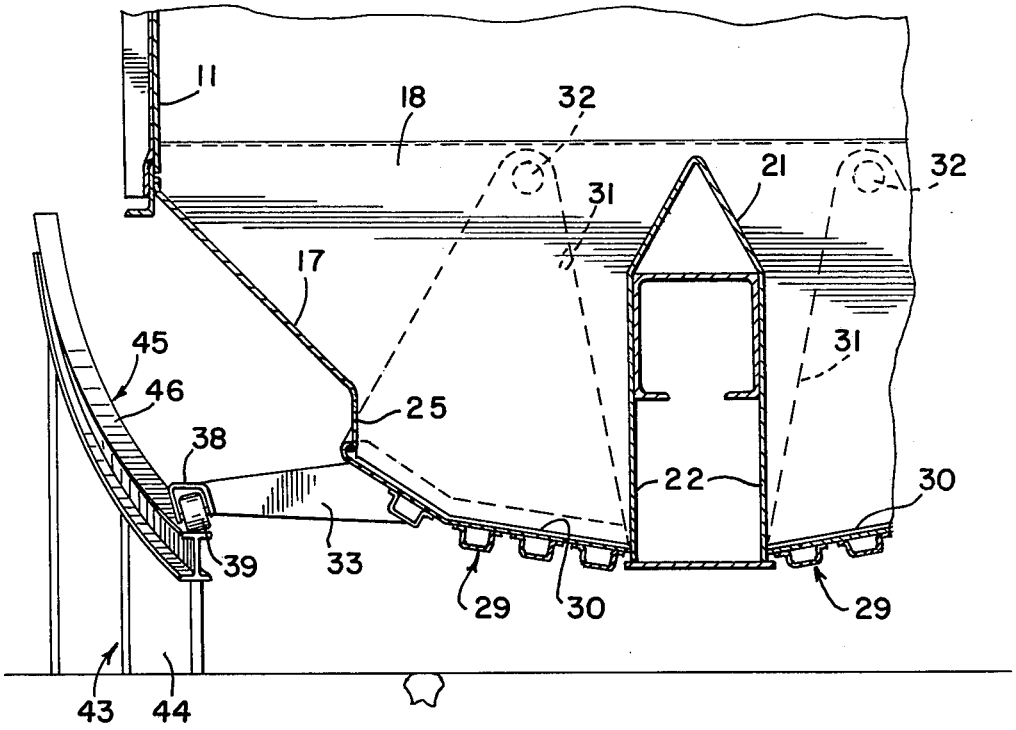
FIG. 5 is a cross-sectional view similar to FIG. 3 showing a modified form of the invention.

Each of the door panels 30 is provided at opposite ends thereof with hanger plates 31 which as best shown in FIGS. 3, 4, and 5, connect the door panels 30 to the central partition wall 18 by means of pivot members 32. Similarly, as best shown in FIG. 1, the hanger plates 31 which support the other ends of the doors are connected by pivot members 32 to suitable structure disposed within the well structures 26. Thus the doors are hingedly mounted for transverse swinging movement. As best shown in FIG. 3, a vertical center line or plane A through the pivot members 32 is disposed to one side of a verticle center line or plane B of the doors 29. Thus it is obvious, because of the off-set pivot connection 32 of the doors, they are constantly urged by gravity and the material contained within the hopper to the closed position shown in FIG. 3.

Figure 6:
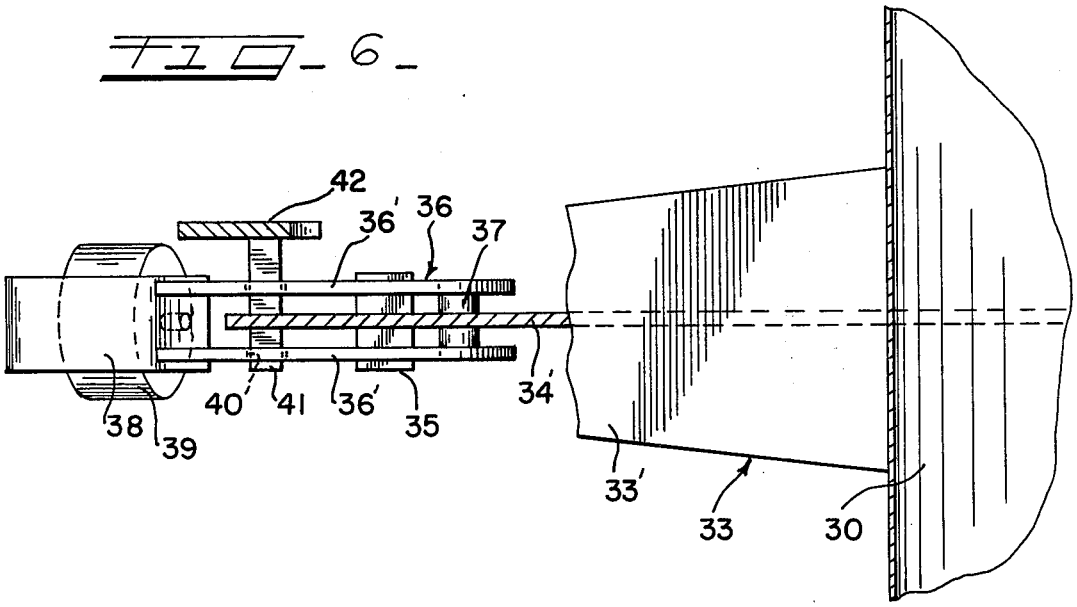
FIG. 6 is a cross-sectional view taken substantially along the line 6—6 of FIG. 3.

Each of the doors or gates 30 is provided with an outwardly extending transverse arm 33 having a horizontal upper flange 33' and a vertical web 34'. Each transverse arm at the outer ends is also provided with an upwardly inclined flange portion 34. The outer end of each transverse arm 33 is provided with a lower ledge 35 on which a lock lever 36 is supported. Each lock lever 36 as best shown in FIG. 6, comprises a pair of plate members 36' pivotally supported by means of a pivot connection 37 on the web 34'. The plate members 36' rest upon the ledge 35 to maintain the door closing position indicated. The outer ends of the plate members 36' are connected to a suitable U-shaped bracket 38 which in turn has pivotally connected thereto a roller or cam follower 39. The lower ends of the plate members 36', as shown in FIGS. 3 and 4, are suitably provided with notches 40 which in the closed position of the door are engaged by stops 41 carried by downwardly extending brackets 42 rigidly mounted on the railway car. The discharge gates or doors are operated from cam structures 43 disposed along side the track on which the railway car travels. Such cam structures generally are provided at the point wherein the material within the car is to be discharged through the track rails into suitable bin arrangements. Each of the cam structures 43 comprises a vertical pedestal 44 having supported thereon at its upper end a cam track 45 having a cam surface 46. As best shown in FIGS. 3 and 4, the cam surfaces 46 extend in inclined relationship with respect to the ground or are diagonally disposed extending substantially in a longitudinal direction along the track in the direction of movement of the car. The cam surfaces extend from a low point 47 to a high point 48 and extend in a curved or arcuate manner outwardly and upwardly.

In the modified structure shown in FIG. 5, the arrangement is substantially identical except the lock arm has been eliminated and the follower wheel 39 and bracket 38 is directly connected to the end of the arm 33. This arrangement may be utilized where locking arrangement is not required.

OPERATION

As the railway car moves in transit the doors are normally biased by gravity to the closed position when empty and this is accentuated more so of course when material within the car is supported upon the doors which remain tightly closed. When the car reaches its destination and the material is to be dumped through the bottom discharge openings the car moves along side the track side cams 43 disclosed. The rollers or followers 39 initially engage the cam surfaces 46 at the lower portions 47 and as the car moves along the rollers travel upwardly on the cam surfaces. During this upward movement as best shown in FIGS. 3 and 4, the lock lever 36 is pivoted upwardly until it engages the flange 34 whereupon the stop 41 is disengaged from the notch 40. This now permits the doors or gates 29 to be swung laterally outwardly to their open position as the cam follower 39 continues on its upward and arcuate travel on the track 45. The arcuate configuration of the cam surface 46 permits the follower 39 to continually travel upwardly and progressively outwardly as the gates are swung to their open position. After the follower moves from the top surface 48 the load has been discharged and the gates are now again free to close by gravity and again assume the lock position shown in FIG. 3.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. For a railway car including a hopper having a bottom bulk discharge opening and sides having inwardly sloping bottom walls, a door assembly operatively associable with a rising trackside camming ramp, including:

a door movable between a closed position covering said opening and an open position to one side of the opening, hinge means supporting the door on the hopper for pendulous movement between said open and closed positions on an axis gravitationally biasing the door to the closed position, a rigid arm on the door cantilevered outwardly therefrom and arresting means on upper portion of said arm, and a locking mechanism for locking the door in the closed position comprising a locking lever including locking means, said lever being movably connected to said arm for vertical swinging movement with respect thereto, catch means on the car engageable by said locking means for restraining the arm against dooropening swinging movement, a cam follower mounted on said locking lever engageable with the camming ramp for serially lifting the lever to a position releasing said locking means from sai catch means and thereafter liftingly engaging the said arresting means on the upper portion of said arm for raising the arm and thereby moving the door to its open position as the cam follower moves along the ramp.

2. The invention in accordance with claim 1, said locking lever being pivotally connected to said arm for limited vertical pivotal movement, said locking means comprising a lower notched surface on the lever engaging said catch means in the closed position, said notched surface being disengaged from said catch means upon engagement of said follower means with said camming ramp.

3. The invention in accordance with claim 2, said cam follower comprising a roller, said arm including a horizontal support ledge providing a lower support for said lever.

4. The invention in accordance with claim 3, said arresting means on the upper portion of said arm comprising a flange extending over said lever.

5. The invention according to claim 1, and coupling means adapted to couple the door to an adjacent bottom wall as the door is gravitationally urged into said closed position, thereby reactively restraining bulging-like distortion of said bottom wall when the hopper is filled with bulk.

6. The invention according to claim 1, and a centrally disposed longitudinally extending support structure within said hopper defining one side of said opening.

* * * * *